United States Patent [19]

Jordan

[11] Patent Number: 5,033,906

[45] Date of Patent: Jul. 23, 1991

[54] CONCRETE IMPRESSION SYSTEM

[76] Inventor: Bradley L. Jordan, Rte. 1, Box 168, Goodman, Mo. 64843

[21] Appl. No.: 566,833

[22] Filed: Aug. 13, 1990

[51] Int. Cl.[5] ..... E01C 19/26

[52] U.S. Cl. ..... 404/124; 425/162

[58] Field of Search ..... 404/72, 124; 164/260

[56] References Cited

U.S. PATENT DOCUMENTS

| | | | |
|---|---|---|---|
| 324,166 | 8/1885 | Riordan . | |
| 397,731 | 2/1889 | Laird et al. . | |
| 519,919 | 5/1894 | Maurer . | |
| 967,714 | 8/1910 | Blome et al. . | |
| 993,086 | 5/1911 | Malloy . | |
| 1,063,752 | 6/1913 | Walling . | |
| 1,099,185 | 6/1914 | Loveland . | |
| 3,406,618 | 10/1968 | Bowman . | |
| 3,832,079 | 8/1974 | Moorhead . | |
| 3,910,738 | 10/1975 | Chandler et al. | 404/124 |
| 4,105,354 | 8/1978 | Bowman . | |
| 4,237,984 | 12/1980 | Cobb et al. | 404/124 |
| 4,766,771 | 8/1988 | Bailey et al. | 164/260 |

*Primary Examiner*—Ramon S. Britts
*Assistant Examiner*—Nancy P. Connolly
*Attorney, Agent, or Firm*—Hovey, Williams, Timmons & Collins

[57] ABSTRACT

A system for imprinting a pattern on a malleable surface includes a roller (12) having a plurality of spaced running ridges (24) and spaced header ridges (26) defining an impression pattern on the roller surface (22) for impressing a corresponding simulated masonary pattern on a malleable surface such as concrete. The ridges (24,26) are configured to procue multiple, adjacent, simulated masonry patterns (80,86) so that adjacent patterns visually and aesthetically merge into one larger pattern.

28 Claims, 1 Drawing Sheet

CONCRETE IMPRESSION SYSTEM

BACKGROUND OF THE INVENTION

1. Field of the Invention

The present invention is broadly concerned with a system for imprinting a pattern on a malleable surface. More particularly, it is concerned with a system having a roller with upstanding impression ridges thereupon configured to product multiple, adjacent, simulated masonry patterns so that the adjacent patterns visually and aesthetically merge into one larger pattern.

2. Description of the Prior Art

Numerous systems exist for producing simulated masonry patterns on a hardenable material such as concrete. One such system involves "stamping" concrete by hand with patterned plates. This system has the drawback of being time-consuming and labor intensive. Consequently, if the area of concrete to be patterned is large this system can be tedious and prohibitively expensive.

Another system illustrated in U.S. Pat. No. 3,832,079 utilizes a roller having a series of patterns formed by means of blades that conform to the pattern that is to be pressed into the concrete. The roller produces simulates mortar joints including simulated running joints extending generally transversely to the direction of movement of the roller. This prior art device, however, it not practical for impressing large areas of concrete in which side-by-side patterns must be impressed. Achieving close alignments is not possible because the varying texture and hardness existing throughout a large area of concrete causes some portions of the roller to travel a greater distance before penetrating a harder area of concrete than other blades which easily penetrate a softer area. The varying distances of travel by different blades causes a misalignment of the running joints of adjacent patterns as illustrated in FIG. 2. This misalignment glaringly exposes the simulated nature of the masonry pattern produced and detracts from the aesthetic appearance of the pattern.

SUMMARY OF THE INVENTION

The prior art problems discussed above are solved and an advance in the state of the art is achieved by the concrete impression system of the present invention. That is to say, the system hereof allows efficient, precise, and aesthetically pleasing creation of simulated masonry patterns is malleable surfaces such as concrete.

Broadly speaking, the system hereof includes a roller having a plurality of ridges upstanding from the surface thereof including a plurality of spaced header ridges and spaced running ridges defining an impression pattern on the surface for impressing a corresponding simulated masonry pattern on a malleable surface. The roller additionally includes an upstanding end ridge extending continuously around one of the roller surface end portions, while the opposing surface end portion is free of any ridges extending continuously therearound.

The running ridges are generally parallel and extend continuously around the roller surface for impressing running joints on the cement in the direction of the movement of the roller. The header ridges are interposed generally transversely between adjacent paris of running ridges and impress header joints in the cement. Each pair of running joints and header joints therebetween define a row of simulated masonry elements separated by header joints. The corresponding header joints of adjacent rows are offset from one another by a first predetermined amount. The corresponding header joints of every other row are offset from one another by less than a second predetermined amount.

DESCRIPTION OF THE PREFERRED EMBODIMENT

Figure 1:
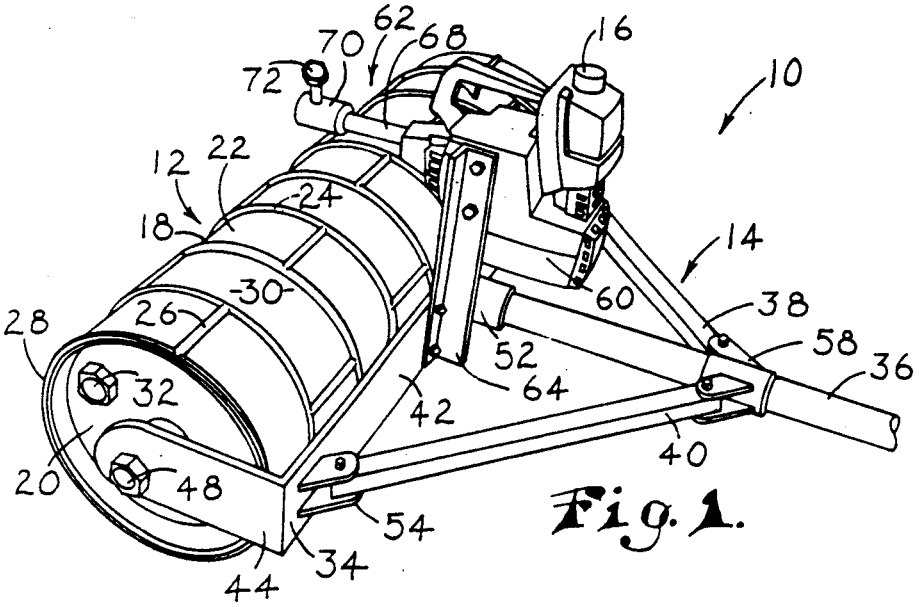
FIG. 1 is a perspective view of a concrete impression apparatus in accordance with the present invention with a portion of the handle cut away.

Referring now to the drawing, and particularly to FIG. 1, concrete impression apparatus 10 includes a roller 12, handle assembly 14 and vibrator 16. Roller 12 is preferably composed of aluminum and includes tubular body 18, circular end cap 20 welded to one end thereof, and a second end cap (not shown) welded to the opposed end together forming an enclosed fluid-receiving chamber within roller 12.

Tubular body 18 presents cylindrically shaped surface 22 having a plurality of upstanding running ridges 24 and header ridges 26 extending therefrom, and including upstanding end ridge 28 extending continuously around an end portion of surface 22 adjacent one edge thereof. Ridges 24, 26 and 28 are preferably formed by ⅜ inch aluminum rod welded to surface 22.

Running ridges 24 and end ridge 28 are equally spaced from one another and extended continuously around surface 22 in order to impress a simulated masonry running joint in a malleable surface in the direction of travel of roller 12, that is to say, to form running joints transverse to the axis of rotation of roller 23. Header ridges 26 extend generally transverse to and between pairs of running ridges 24. With this configuration, header ridges 26 from respective rows of impression hollows 30 for creating simulated masonry elements in a malleable surface.

As illustrated in FIG. 1, header ridges 26 in adjacent rows (as defined by pairs of running ridges 24) are offset from one other preferably by one-half the length of an impression hollow 30. For example, for an impression hollow 30 of six inches in length (corresponding to a masonry element of the same length) the preferred offset is three inches for header ridges in adjacent rows. Close inspection of FIG. 1 also illustrates that header ridges 26 in every other row are also offset from one another by a small amount so that header ridges 26 and the header joints formed thereby are not aligned with one another. This amount is preferably less than one-eighth of the length of an impression hollow 30 and thereby preferably less than three-fourths of an inch. It should be noted that the amount of offset is not constant but is different for corresponding rows in order to prevent alignment of a significant number of header ridges in any corresponding set thereof.

End ridge 28 is provided to also form a simulated masonry running ridge as illustrated in FIG. 1 on the leftmost portion of surface 22. It should be noted, however, that the rightmost portion of surface 22 includes no such end ridge so that adjacent simulated masonry patterns formed by apparatus 10 can visually merge as explained further hereinbelow.

End cap 20 includes a fluid-receiving aperture defined therein and communicating with the interior chamber of roller 12. Closure bolt 32 is threadably received in this aperture to prevent fluid escape.

Handle assembly 14 provides the means for rollingly propelling roller 12 and, in the preferred embodiment, it is modified from the handle assembly of a conventional "bull float" concrete finishing tool. Assembly 14 includes C-shaped member 34, elongated tubular handle 36 and diagonal braces 38 and 40. Member 34 includes straight portion 42 having a respective pair of coupling legs 44 and 46 extending therefrom. Legs 44,46 are suitably apertured to receive rotation bolts 48,50 therethrough which are, in turn, threadably received in the two end caps of roller 12 using respective flanges bearings (not shown) to rotatably couple along the axis of roller 12 so that assembly 14 is rotatably coupled with roller 12. Straight portion 42 includes handle-receiving tube 52 and a pair of brace-supporting brackets 54 and 56 welded thereto.

Handle 36 is tubularly shaped with one end thereof received in tube 52 and the distal end thereof presented for grasping by the user or coupling with a power propulsion unit. Handle 36 includes bracket 58 which is coupled with one end of each diagonal brace 38,40, and with the other ends of braces 38, 40 coupled with brackets 54,56.

Figure 3:
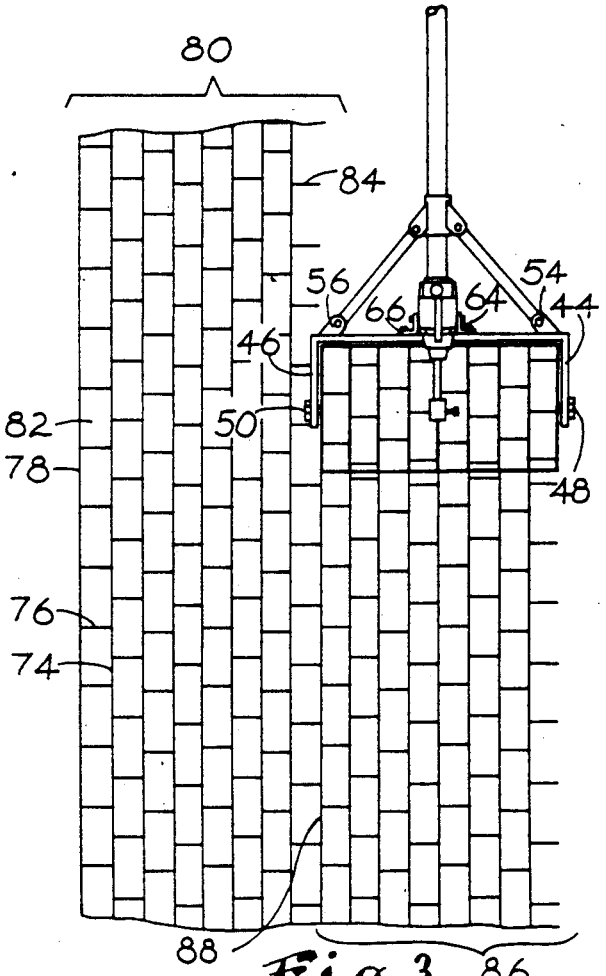
FIG. 3 is an plan view of the simulated masonry pattern produced by the apparatus of FIG. 1 illustrating the running joints extending in the direction of roller movement and the visual merging of adjacent patterns.

Vibrator 16 is used to induce vibration in apparatus 10 in order to enhance the impression making ability thereof. Vibrator 16 includes rotation power unit 60, rotation assembly 62, and support angles 64 and 66. Power unit 60 is preferably a gasoline-powered weed trimming engine. Rotation assembly 62 includes rotation shaft 68 formed by truncating the shaft of power unit 60, rotation block 70 coupled to the end of shaft 68, and vibration bolt 72 threadably received in the side of block 70. The upper portions of angles 64 and 66 are bolted to opposed sides of power unit 60 and the lower portions thereof are bolted to straight portion 42 as shown in FIGS. 1 and 3. Rapid rotation of shaft 68 and block 70 with bolt 72 attached thereto induces vibration because the weight of bolt 72 is offset from the axis of rotation. The vibration so induced is transmitted to roller 12 by way of angles 64,66 and handle assembly 16. As those skilled in the art will appreciate, bolt 72 can be interchanged with bolts of greater or lesser weight and size to achieve the desired level of vibration.

The preferred method of the present invention uses apparatus 10 to impress a simulated masonry pattern on a malleable surface such as wet concrete. In this preferred use, apparatus 10 is placed on the surface to be formed with end ridge 28 along one edge thereof such as the lower left edge of FIG. 3. The user then grasps the handle 36 and propels apparatus 10 which induces rotation in roller 12. As roller 12 travels along the malleable surface, ridges 24,26 and 28 create grooves therein simulative of masonry joints which include running joints 74 and header joints 76. Furthermore, end ridge 28 creates an additional running joint 78.

Figure 2:
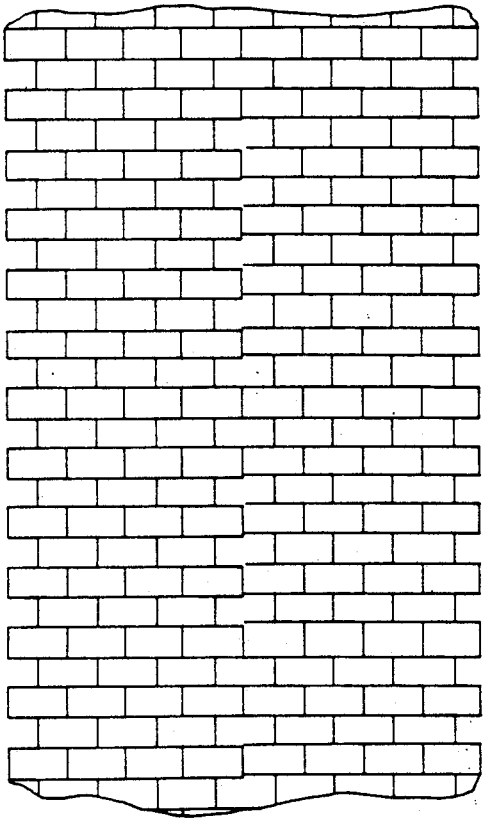
Fig. 2. PRIOR ART
FIG. 2 is an overhead view of side-by-side masonry patterns produced by prior art illustrating the transverse positioning and the misalignment of the running joints.

As FIG. 3 illustrates, running joints 74 and 78 extend continuously in the direction of travel of roller 12 which is in contrast to the prior art illustrated in FIG. 2, and with header joints 76 discontinuous and generally transverse to running joints 74 and 78.

Upon completion of the first pass of apparatus 10, a first simulated masonry pattern 80 is created presenting the respective simulated masonry joints 74–78 which in turn define simulated masonry elements 82. As shown in FIG. 3 one edge of first pattern 80 presents running joint 78 created by end ridge 28. The opposed edge of first pattern 80 has no outer running joint and present a plurality of exposed header ridges 84.

To create a second simulated masonry pattern 86 adjacent first pattern 80, apparatus 10 is repositioned with end ridge 28 aligned adjacent exposed header joints 84. Apparatus 10 is then propelled over the malleable surface parallel to the first pass with end ridge 28 creating a new and additional running joint 88 along the exposed ends of exposed header joints 84. In this way, additional running joint 88 is common to both patterns 80 and 86 and results in the visual merging of patterns 80,86 as shown in FIG. 3.

Second pattern 86 also presents exposed header joints 84 which allows the merging of additional patterns created by additional passes of apparatus 10. If the last pass of apparatus 10 completes the pattern, it is advantageous to position exposed header joints 84 so that they abut the concrete form along the rightmost edge of the pattern, and thereby form a natural termination to the pattern.

FIG. 3 also illustrates that adjacent pairs of running joints 74 (and also running joints 78 and 88) include transverse header joints 84 therebetween which define a row of simulated masonry elements 82. As can be observed in FIG. 3, the header joints of adjacent rows are offset from one another by a predetermined amount which is about one-half the length of masonry element 82 which offset is about three inches for the element length of six inches, as predetermined by the offset of adjacent header ridges 26 of apparatus 10.

Furthermore, close inspection of FIG. 3 illustrates that the corresponding header joints of every other two are not aligned with one another, but rather are offset by an amount predetermined by the offset of the header ridges 26 of apparatus 10. This deliberate misalignment of header ridges along with the placement of common running joint 88 allows patterns 80 and 86 to visually merge as illustrated in FIG. 3, and in contrast of the prior art of FIG. 2. In other words, even though the two passes of roller 12 over the malleable surface may result in variations in alignment, these variations are not apparent in FIG. 3 because header joints 76 and 84 are deliberately misaligned. That is to say, because corresponding header joints 76 and 84 are deliberately misaligned, a straight-line pattern in the header joints is not attempted, as a result misalignment is not apparent.

This is in contrast to the prior art of FIG. 2 in which the unavoidable misalignment of the two patterns is obvious, prevents visual merging of the two patterns, and detracts from the aesthetic appearance of the work. As shown in FIG. 3, the misalignment problem does not exist with apparatus 10 because it produces running joints 74, 74 and 88 extending in the direction of movement of the roller 12. The pattern produced also realistically simulates the pattern produced by actual brick and mortar. This realistic appearance is enhanced by the offsets between the corresponding header joints in neighboring rows. Because of the above mentioned variable surface hardness of fresh cement, it would be very difficult to align the header joints of a first pattern with a second adjacent pattern. This misalignment of the header joints of adjacent patterns might give the overall pattern an undesirable appearance with problems similar to that of the prior art as shown in FIG. 2.

The offsets solve this problem by giving the simulated elements 82 of the merged patterns a somewhat "random" appearance which more closely resembles an actual masonry pattern. In the preferred embodiment, the header joints of adjacent rows are offset a first amount approximately one half the length of one simulated masonry element 82. The header joints of every other row are offset by a second amount less than approximately one eighth the length of one simulated masonry element 82.

Also includes in the preferred embodiment is a hollow chamber within roller 12 designed to hold approximately 100 lbs of fluid and closure bolt 32 through which fluid is added to the chamber. Adding water allows the weight of the roller to be increased to achieve greater penetration of the ridges into harder surfaces when necessary. For instance, when warmer temperatures quicken the set time of cement, fluid can be added to increase the roller's 12 weight and thereby allow for greater penetration of the ridges into the harder cement. Greater penetration by the ridges is also enhanced by vibrator 16. The vibrations induced in the roller 12 by the vibrator 16 allow the ridges to penetrate harder surfaces.

If a smooth surface texture is desired, the surface to be patterned can first be overlayed with a thin film of flexible synthetic resin material. The synthetic material separates the roller 12 from the surface material as the roller is moved across the surface. This separation prevents any of the surface material from sticking to the roller 12 in order to give the surface a smooth texture. If a mottled surface texture is desired, no overlay should be used so that the surface material will adhere slightly to the roller as it is moved over the surface. To further enhance the aesthetic appearance, coloring agents can be used as part of the concrete or surface applied thereto, and can additionally be used for the joints by painting with the desired color.

As those skilled in the art can appreciate, the shape of the running ridges 24 and header ridges 26 can be varied to produce different types of masonry patterns. For example, the ridges would be generally linear if a brick pattern is desired, or curvilinear if some type of a cobblestone pattern is desired. Also, the preferred ridges could be configured to present a very narrow configuration so that the pattern produced thereby simulates close-fitting bricks without mortar. Additionally, lead shot could be used to increase the weight of roller 12 instead of the preferred and easily removable fluid. Furthermore, vibrator 16 could be powered by an electric motor instead of the preferred gasoline engine. As a final example, roller 12 could be constructed of synthetic resin material with the ridges integrally formed therewith, instead of the preferred aluminum.

I claim:

1. An apparatus for producing a plurality of adjacent, parallel patterns on a malleable surface, the patterns being simulative of masonry such a bricks or cobblestones with mortar joints therebetween each pattern presenting opposed side edges, each pattern presenting opposed side edges, said apparats comprising:

a roller presenting an outer, cylindrically shaped surface presenting opposed end portions;

a plurality of ridges, upstanding from said roller surface about the periphery thereof and defining an impression pattern thereon for impressing a corresponding simulated masonry pattern having simulated running joints extending continuously in generally parallel fashion along the pattern and having simulated header joints interposed between adjacent pairs of said running joints on a malleable surface, said ridges including a plurality of spaced, generally parallel running ridges extending around said surface for impressing said running joints on the malleable surface, and a plurality of header ridges interposed between adjacent pairs of said running ridges and generally transverse thereto for impressing said simulated header joints on the malleable surface; and structural means, including an upstanding end ridge extending around one of said roller surface end portions and presenting the other of said end portions with header ridges free of an end ridge, for producing a masonry pattern on a malleable surface presenting a running joint along one edge thereof and presenting the other pattern edge with header joints without a running joint therealong, and for producing a second adjacent parallel pattern with the running joint thereof also as the pattern edge running joint of said first pattern.

2. The apparatus as set forth in claim 1, further including means for enhancing the definition of the grooves defined in the malleable surface during movement of said roller over the malleable surface.

3. The apparatus as set forth in claim 2, said enhancing means including means for increasing the downward force exerted by said roller on the malleable surface.

4. The apparatus as set forth in claim 3, said roller including walls defining a fluid receiving chamber therein, said force increasing means including means for introducing a fluid into said chamber for increasing the weight of said roller in order to enhance the definition of the grooves.

5. The apparatus as set forth in claim 2, said enhancing means including means for vibrating said roller.

6. The apparatus as set forth in claim 5, said vibrating means including a rotatable shaft, means for rapidly rotating said shaft, a weight, and means for coupling said weight with said shaft offset from the axis of rotation thereof in order to induce vibration during rotation of said shaft and thereby induce vibration of said roller.

7. The apparatus as set forth in claim 6, said means for coupling said weight with said shaft including means allowing replacement of said weight with a different weight for varying the amount of vibration so induced.

8. The apparatus as set forth in claim 6, said rotating means including a gasoline-powered engine.

9. The apparatus as set forth in claim 6, said rotating means including an electric motor.

10. The apparatus as set forth in claim 1, the malleable surface including wet concrete.

11. The apparatus as set forth in claim 1, said ridges being formed of weld beads welded to said surface.

12. The apparatus as set forth in claim 11, said weld beads being composed of aluminum.

13. The apparatus as set forth in claim 1, said roller being composed substantially of non-rusting material.

14. The apparatus as set forth in claim 13, said non-rusting material including aluminum.

15. The apparatus as set forth in claim 1, said simulated header joints being substantially linear.

16. The apparatus as set forth in claim 1, said simulated header joints being curvilinear.

17. The apparatus as set forth in claim 1, said propelling means including an elongated handle having a yoke-shaped extension coupled thereto with the distal ends of said extension rotatably coupled with opposed ends of said roller along the axis of rotation thereof.

18. The apparatus as set forth in claim 1, said running ridges including a plurality of pairs thereof with said header ridges extending therebetween, each pair of running ridges and header joints therebetween defining a row of impression hollows separated by said header ridges and extending continuously around said surface for producing a corresponding plurality of simulated masonry elements in the malleable surface, the header ridge being configured so that the header ridges of the adjacent rows are offset from one another from a first predetermined amount and so that the header joints of every other row are offset from one another by less than a second predetermined amount, said second predetermined amount being less than first predetermined amount.

19. The apparatus as set forth in claim 18, said first predetermined amount being about one-half the length of one of said impression hollows, said second predetermined amount being less than about one-eighth the length of one of said impression hollows.

20. The apparatus as set forth in claim 18, wherein said first predetermined amount is about three inches, and wherein said second predetermined amount is about three-fourths of an inch.

21. A method of producing a pattern on a malleable surface, the pattern being simulative of masonry such as bricks or cobblestones with mortar joints therebetween, said method comprising the steps of:

providing a roller presenting an outer, cylindrically shaped surface presenting opposed end portions, and including a plurality of ridges, upstanding from said roller surface about the periphery thereof and defining an impression pattern thereon for impressing a corresponding simulated masonry pattern having simulated running joints extending continuously in generally parallel fashion along the pattern and having simulated header joints interposed between adjacent pairs of said running joints on a malleable surface, said ridges including a plurality of spaced, generally parallel running ridges extending continuously around said surface for impressing said running joints on the malleable surface, and a plurality of header ridges interposed between adjacent pairs of said running ridges and generally transverse thereto for impressing said simulated header joints on the malleable surface, and structural means, including an upstanding end ridge extending around one of said roller surface end portions and presenting the other of said end portions with header ridges free of an end ridge, for producing a masonry pattern on a malleable surface presenting a running joint along one edge thereof and presenting the other pattern edge with header joints without a running joint along one edge thereof and presenting the other pattern edge with header joints without a running joint therealong, and for producing a second adjacent parallel pattern with the running joint thereof also as the pattern edge running joint of said first pattern rollingly propelling said roller over a malleable surface in order to impress the simulated masonry pattern thereon with the pattern-edge running joint along one edge of the simulated masonry pattern and with the opposed edge hereof free of any simulated running joint, and in order to form the running joints in the direction of movement of the roller.

22. The method as set forth in claim 21, further including the step of increasing the weight of said roller in order to enhance the pattern impression-making ability of said roller in the malleable surface.

23. The method as set forth in claim 22, said roller including structure defining a fluid-receiving chamber therein, said increasing step including the step of adding fluid to said chamber in order to increase the weight of said roller.

24. The method as set forth in claim 21, further including the step of vibrating said roller in order to increase the impression making ability of said roller in the malleable surface.

25. The method as set forth in claim 21, the malleable surface being formed from a wetted flowable material, said material being hardenable upon dying, the malleable surface, while wet, being slightly adherable to said roller surface, said method further including the step of propelling said roller over the malleable surface while wet so that surface portions thereof adhere to said roller and thereby create a mottled appearance of the surface.

26. The method as set forth in claim 21, further including the steps of applying a thin, flexible film of synthetic resin material to the malleable surface before propelling said roller thereover, and subsequently propelling said roller over the malleable surface with said film therebetween.

27. The method as set forth in claim 21, said pattern being a first pattern, said method further including the step of propelling said roller over the malleable surface adjacent said first pattern with said end ridge being propelled along and adjacent to said opposed edge of said first pattern to create a second pattern with the running joint created by said running ridge forming a running joint common to both of said patterns thereby visually merging both of said patterns into one larger pattern.

28. The apparatus as set forth in claim 1 further including means coupled with said roller for rollingly propelling said roller over a malleable surface in order to impress the simulated masonry pattern thereon.

* * * * *

UNITED STATES PATENT AND TRADEMARK OFFICE

CERTIFICATE OF CORRECTION

PATENT NO. : 5,033,906

DATED : 23 July 1991

INVENTOR(S) : Bradley L. Jordan

It is certified that error appears in the above-identified patent and that said Letters Patent is hereby corrected as shown below:

Column 5, line 60, replace "a" with --as--.

Column 5, line 61, after "therebetween" add --,--.

Column 5, lines 62 and 63, delete "each pattern presenting opposed side edges,".

Column 5, line 63, change "apparats" to --apparatus--.

Column 8, lines 5-7, delete "and presenting the other pattern edge with header joints without a running joint therealong".

Column 8, line 10, after "pattern" add --; and--.

Signed and Sealed this

Thirty-first Day of August, 1993

Bruce Lehman

*Attest:*

BRUCE LEHMAN

*Attesting Officer*

*Commissioner of Patents and Trademarks*